US009112269B2

(12) United States Patent
Wong et al.

(10) Patent No.: US 9,112,269 B2
(45) Date of Patent: Aug. 18, 2015

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Yi-Ting Hsieh, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 214 days.

(21) Appl. No.: 13/951,393

(22) Filed: Jul. 25, 2013

(65) Prior Publication Data

US 2014/0320358 A1 Oct. 30, 2014

(30) Foreign Application Priority Data

Apr. 24, 2013 (TW) ..... 102114536 A

(51) Int. Cl.

| | |
|---|---|
| ***H01Q 9/00*** | (2006.01) |
| ***H01Q 9/30*** | (2006.01) |
| ***H01Q 1/24*** | (2006.01) |
| ***H01Q 9/42*** | (2006.01) |
| ***H01Q 5/35*** | (2015.01) |

(52) U.S. Cl.

CPC ..... *H01Q 9/30* (2013.01); *H01Q 1/243* (2013.01); *H01Q 5/35* (2015.01); *H01Q 9/42* (2013.01)

(58) Field of Classification Search

CPC ..... H01Q 5/35; H01Q 1/243; H01Q 9/30; H01Q 9/42

See application file for complete search history.

(56) References Cited

U.S. PATENT DOCUMENTS

| | | | | |
|---|---|---|---|---|
| 7,886,499 | B2 * | 2/2011 | Okuda et al. | 52/750 |
| 7,889,143 | B2 * | 2/2011 | Milosavljevic et al. | 343/722 |
| 8,581,799 | B2 * | 11/2013 | Choi et al. | 343/845 |
| 2005/0259010 | A1 * | 11/2005 | Soutome | 343/702 |
| 2009/0002248 | A1 * | 1/2009 | Zhao et al. | 343/722 |
| 2011/0207422 | A1 * | 8/2011 | Ban et al. | 455/128 |
| 2011/0215972 | A1 * | 9/2011 | Wong et al. | 343/702 |
| 2013/0234903 | A1 * | 9/2013 | Kwak et al. | 343/750 |
| 2013/0241796 | A1 * | 9/2013 | Nagumo | 343/861 |
| 2013/0300615 | A1 * | 11/2013 | Wong et al. | 343/702 |

* cited by examiner

*Primary Examiner* — Trinh Dinh

(74) *Attorney, Agent, or Firm* — McClure, Qualey & Rodack, LLP

(57) ABSTRACT

A communication device including a ground element and an antenna element is provided. An edge of the ground element has a notch, and the antenna element includes a metal element disposed inside the notch. The metal element of the antenna element has a first end and a second end. The first and second ends are spaced away from each other and are respectively positioned adjacent to two ends of a diagonal line of the notch. The first end is used as a first feeding point of the antenna element, and the second end is used as a second feeding point of the antenna element. The first feeding point is coupled through a switch and a first matching circuit to a first signal source, and the second feeding point is coupled through an inductive element and a second matching circuit to a second signal source.

10 Claims, 5 Drawing Sheets

COMMUNICATION DEVICE AND ANTENNA ELEMENT THEREIN

CROSS REFERENCE TO RELATED APPLICATIONS

This Application claims priority of Taiwan Patent Application No. 102114536 filed on Apr. 24, 2013, the entirety of which is incorporated by reference herein.

BACKGROUND OF THE INVENTION

1. Field of the Invention

The disclosure generally relates to a communication device, and more particularly, relates to a mobile communication device comprising a switchable dual-feed antenna element.

2. Description of the Related Art

With fast development in the wireless communication industry nowadays, the use of communication devices for human beings is not merely limited to talking. Instead, the users demand communication devices to have more and more functions. To satisfy the users' requirements and to maintain the thin and small appearance of a communication device, efficient utilization of the limited space inside the communication device is very important.

It is a critical challenge for antenna designers to design an antenna element configured to cover multiple bands with smaller available space in a communication device.

BRIEF SUMMARY OF THE INVENTION

The invention is aimed to provide a communication device and a switchable dual-feed antenna element therein. The communication device at least comprises an antenna element and a ground element. A ground plane antenna with an asymmetrical dipole antenna structure is formed by the antenna element and the ground element. The antenna element has two different feeding points. On the condition that the antenna size is unchanged, the antenna element is selectively coupled to different matching circuits to operate in a plurality of communication bands comprising high bands and low bands by controlling closed and open states of a switch circuit. Accordingly, the invention can achieve multi-band operations of a compact antenna element.

In a preferred embodiment, the invention provides a communication device, comprising: a ground element, wherein an edge of the ground element has a notch; and an antenna element, comprising a metal element, wherein the metal element is disposed inside the notch, and the metal element has a first end and a second end. The first end and the second end are spaced away from each other and are respectively positioned adjacent to two ends of a diagonal line of the notch. The first end of the metal element is used as a first feeding point of the antenna element, and the second end of the metal element is used as a second feeding point of the antenna element, wherein the first feeding point is coupled through a switch and a first matching circuit to a first signal source, and the second feeding point is coupled through an inductive element and a second matching circuit to a second signal source.

In some embodiments, the antenna element may operate as follows. When the antenna element is fed from the second feeding point, the switch coupled to the first feeding point is switched to be open. Accordingly, the antenna element is not affected by the first feeding point, and generates a second resonant mode in a second band (lower band). On the other hand, when the antenna element is fed from the first feeding point, the switch coupled to the first feeding point is switched to be closed. The first signal source feeds the antenna element through the first feeding point, and the antenna element generates a first resonant mode in a first band (higher band). Note that the second feeding point is not coupled to another switch to prevent the second feeding point from affecting the first resonant mode in the first band. Instead, the second feeding point is coupled to an inductive element. Since the inductive element provides high impedance in a high band, the inductive element can effectively solve the problem of the resonant currents flowing to the second feeding point when the first resonant mode in the first band is excited. Accordingly, the first feeding point and the second feeding point do not interfere with each other in the first band. That is, the function of an inductive element is similar to that of the mentioned switch.

In some embodiments, when the antenna element operates in the first band, the first matching circuit provides a first reactance such that a total length of a resonant path of the antenna element is smaller than 0.15 wavelength of the lowest frequency in the first band, and the total length is much smaller than 0.25 wavelength of the relative prior art. When the antenna element operates in the second band, the second matching circuit provides a second reactance such that the total length of the resonant path of the antenna element is smaller than 0.15 wavelength of the lowest frequency in the second band, and the total length is much smaller than 0.25 wavelength of the relative prior art.

In some embodiments, the first band at least covers bands which are approximately from 1710 MHz to 2690 MHz, and the second band at least covers bands which are approximately from 824 MHz to 960 MHz. In some embodiments, the inductive element is a chip inductor, a distributed inductor, or a combination of the chip inductor and the distributed inductor. In some embodiments, the metal element substantially has an inverted L-shape or a triangular shape. In some embodiments, the notch of the ground element substantially has a rectangular shape or substantially has a smoothly curved edge. In some embodiments, the notch of the ground element is substantially formed at a corner of the ground element.

In some embodiments, the notch in which the antenna element is disposed has a small size of about 150 $mm^2$ (10 mm by 15 mm). With such a small size, the antenna element can at least cover two wide bands of GSM850/900 bands and GSM1800/1900/UMTS/LTE2300/2500 bands.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are described in detail as follows.

Figure 1:
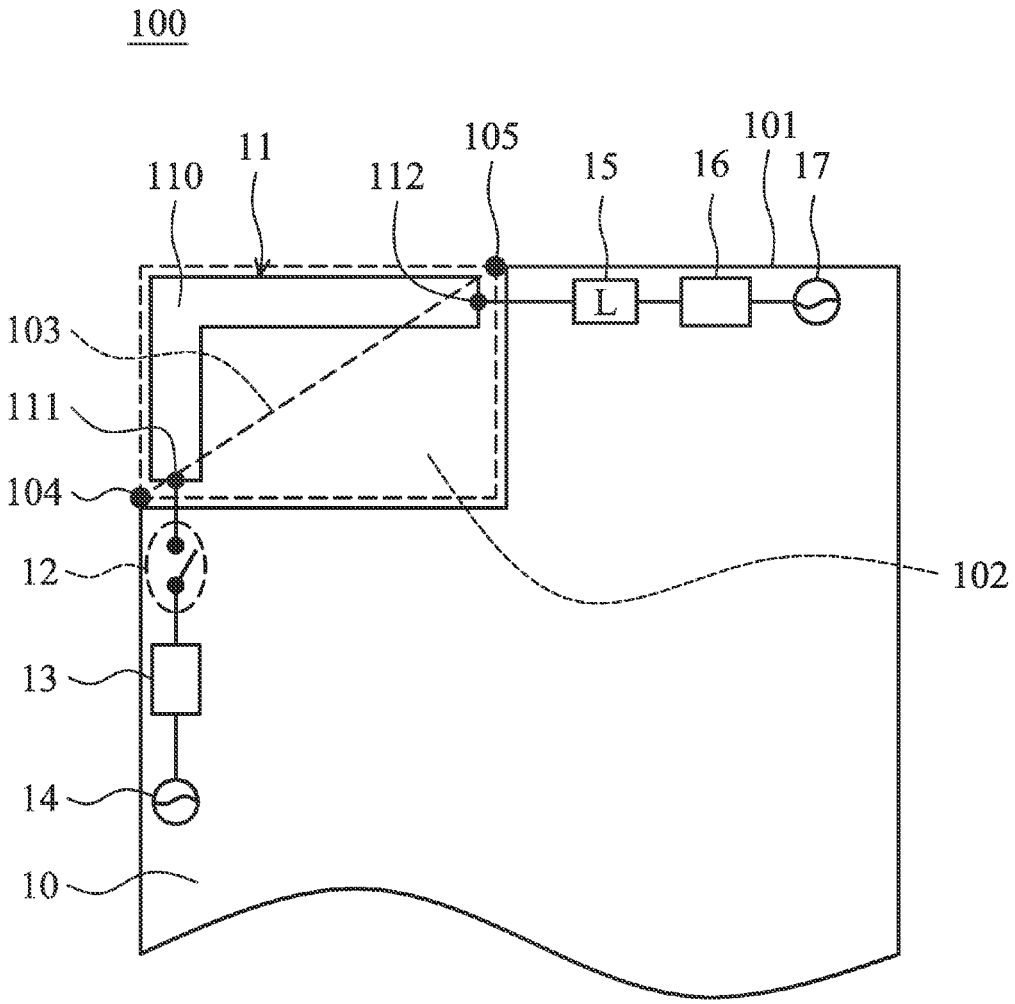
FIG. 1 is a diagram for illustrating a communication device according to a first embodiment of the invention.

FIG. 1 is a diagram for illustrating a communication device 100 according to a first embodiment of the invention. The communication device 100 may be a smart phone, a tablet computer, or a notebook computer. As shown in FIG. 1, the communication device 100 at least comprises a ground element 10 and an antenna element 11. The ground element 10 may be a metal plane which is disposed on a dielectric substrate (not shown), such as an FR4 (Flame Resistant-4) substrate or a system circuit board. An edge 101 of the ground element 10 has a notch 102. In some embodiments, the notch 102 of the ground element 10 is substantially formed at a corner of the ground element 10. The antenna element 11 comprises a metal element 110 which is disposed inside the notch 102 of the ground element 10. In the embodiment, the notch 102 of the ground element 10 substantially has a rectangular shape, and the metal element 110 substantially has an inverted L-shape. However, the invention is not limited to the above. In other embodiments, the notch 102 of the ground element 10 may substantially have other shapes, such as a triangular shape, a pentagonal shape, a circular arc shape, or an irregular shape, and the metal element 110 may substantially have other shapes, such as a straight-line shape, a J-shape, a U-shape, a W-shape, or an S-shape. The metal element 110 has a first end 111 and a second end 112. The first end 111 and the second end 112 of the metal element 110 are spaced away from each other, and are respectively positioned adjacent to two ends 104 and 105 of a diagonal line 103 of the notch 102.

The first end 111 of the metal element 110 is used as a first feeding point of the antenna element 11, and the second end 112 of the metal element 110 is used as a second feeding point of the antenna element 11. The first feeding point is coupled through a switch 12 and a first matching circuit 13 to a first signal source 14, and the second feeding point is coupled through an inductive element 15 and a second matching circuit 16 to a second signal source 17. In some embodiments, each of the first matching circuit 13 and the second matching circuit 16 comprises one or more capacitors and inductors (not shown). In some embodiments, the inductive element 15 is a chip inductor, a distributed inductor, or a combination of the chip inductor and the distributed inductor. In some embodiments, the switch 12 is implemented with a PIN diode. When the switch 12 is closed, the antenna element 11 receives power from the first feeding point and operates in a first band. When the switch 12 is open, the antenna element 11 receives power from the second feeding point and operates in a second band. The frequencies of the second band are lower than the frequencies of the first band. The inductive element 15 prevents the resonant currents from flowing into the second feeding point in the first band. The first matching circuit 13 provides a first reactance, and a total length of the metal element 110 is smaller than 0.15 wavelength of the lowest frequency in the first band. The second matching circuit 16 provides a second reactance, and the total length of the metal element 110 is smaller than 0.15 wavelength of the lowest frequency in the second band. In some embodiments, the communication device 100 further comprises a control unit (not shown). The control unit selectively closes and opens the switch 12 according to a user input signal or a detection signal. In some embodiments, the communication device 100 further comprises a sensor (not shown). The sensor detects a frequency of an electromagnetic signal nearby and accordingly generates the detection signal. Note that the communication device 100 may further comprise other components, such as a touch panel, a processor, a speaker, a battery, and a housing (not shown).

Figure 2:
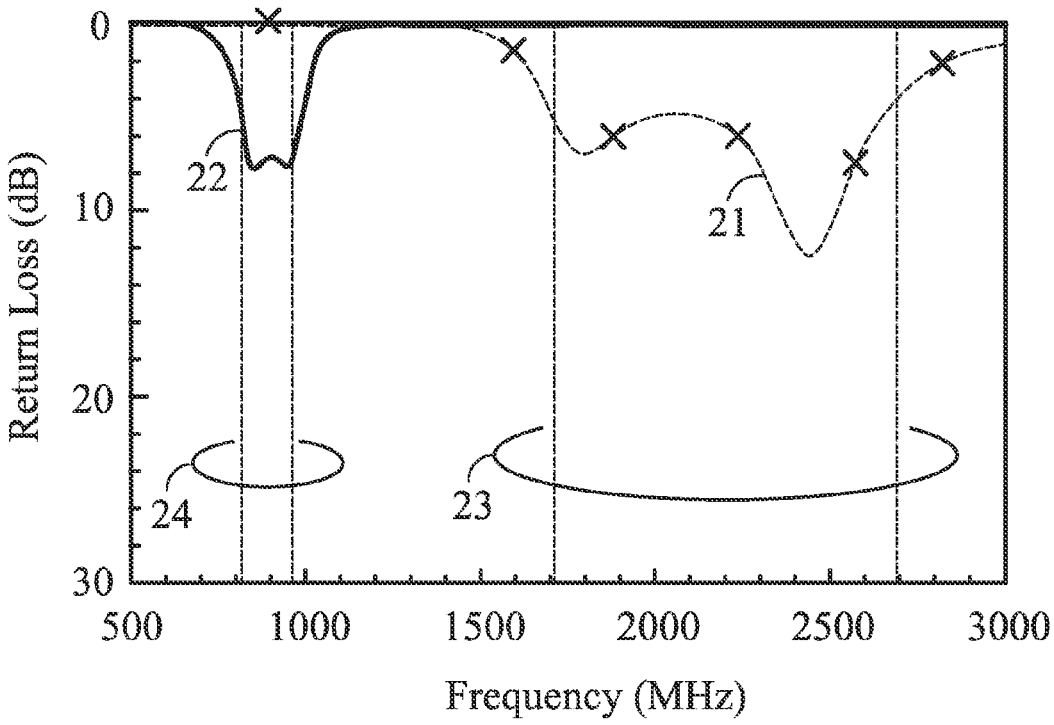
FIG. 2 is a diagram for illustrating return loss of an antenna element when a switch is closed or opened according to a first embodiment of the invention.

FIG. 2 is a diagram for illustrating return loss of the antenna element 11 when the switch 12 is closed or opened according to the first embodiment of the invention. In the embodiment, the notch 102 in which the metal element 110 of the antenna element 11 is disposed has a size of merely 150 $mm^2$ (10 mm by 15 mm), and the ground element 10 has a size of merely 7200 $mm^2$ (120 mm by 60 mm). When the switch 12 is closed, according to a return loss curve 21 of the antenna element 11, the antenna element 11 can cover a first band 23. When the switch 12 is open, according to a return loss curve 22 of the antenna element 11, the antenna element 11 can cover a second band 24. In a preferred embodiment, the first band 23 covers GSM1800/1900/UMTS/LTE2300/2500 bands which are approximately from 1710 MHz to 2690 MHz, and the second band 24 covers GSM850/900 bands which are approximately from 824 MHz to 960 MHz.

Figure 3:
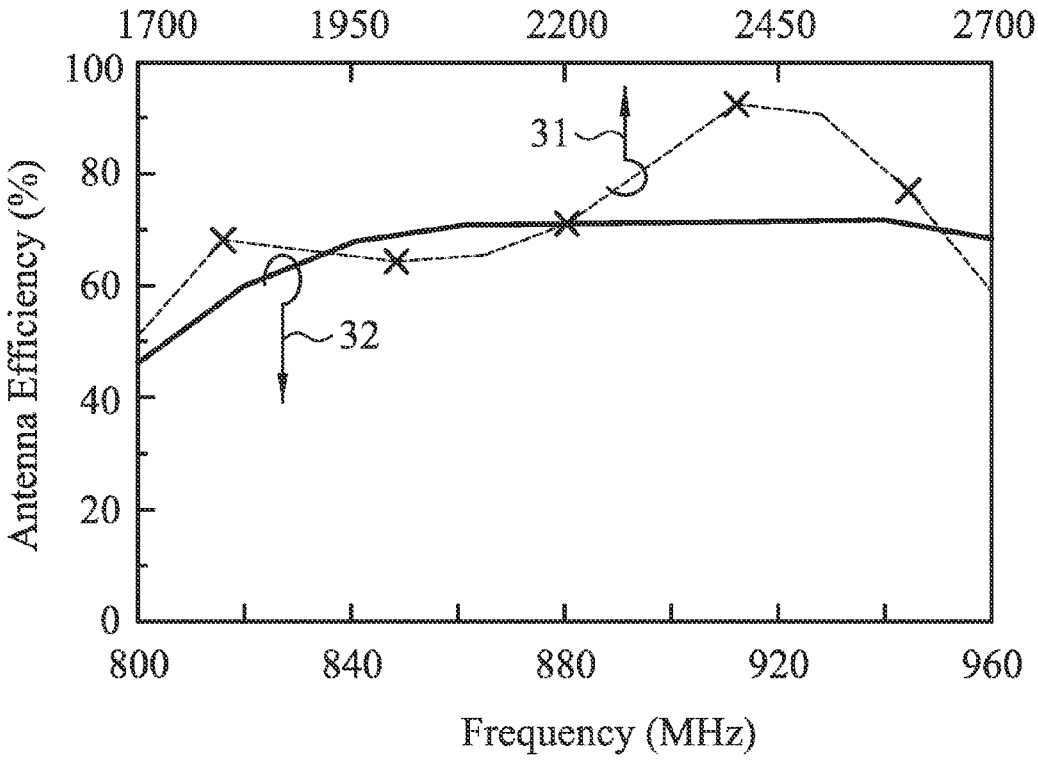
FIG. 3 is a diagram for illustrating antenna efficiency of an antenna element when a switch is closed or opened according to a first embodiment of the invention.

FIG. 3 is a diagram for illustrating antenna efficiency of the antenna element 11 when the switch 12 is closed or opened according to the first embodiment of the invention. When the switch 12 is closed, according to an antenna efficiency curve 31 of the antenna element 11, the antenna efficiency of the antenna element 11 (return losses included) is approximately from 58% to 92% in the first band 23. When the switch 12 is open, according to an antenna efficiency curve 32 of the antenna element 11, the antenna efficiency of the antenna element 11 (return losses included) is approximately from 60% to 72% in the second band 24. Accordingly, the antenna element 11 has good antenna efficiency in both of the first band 23 and the second band 24 and meets application requirements.

Figure 4:
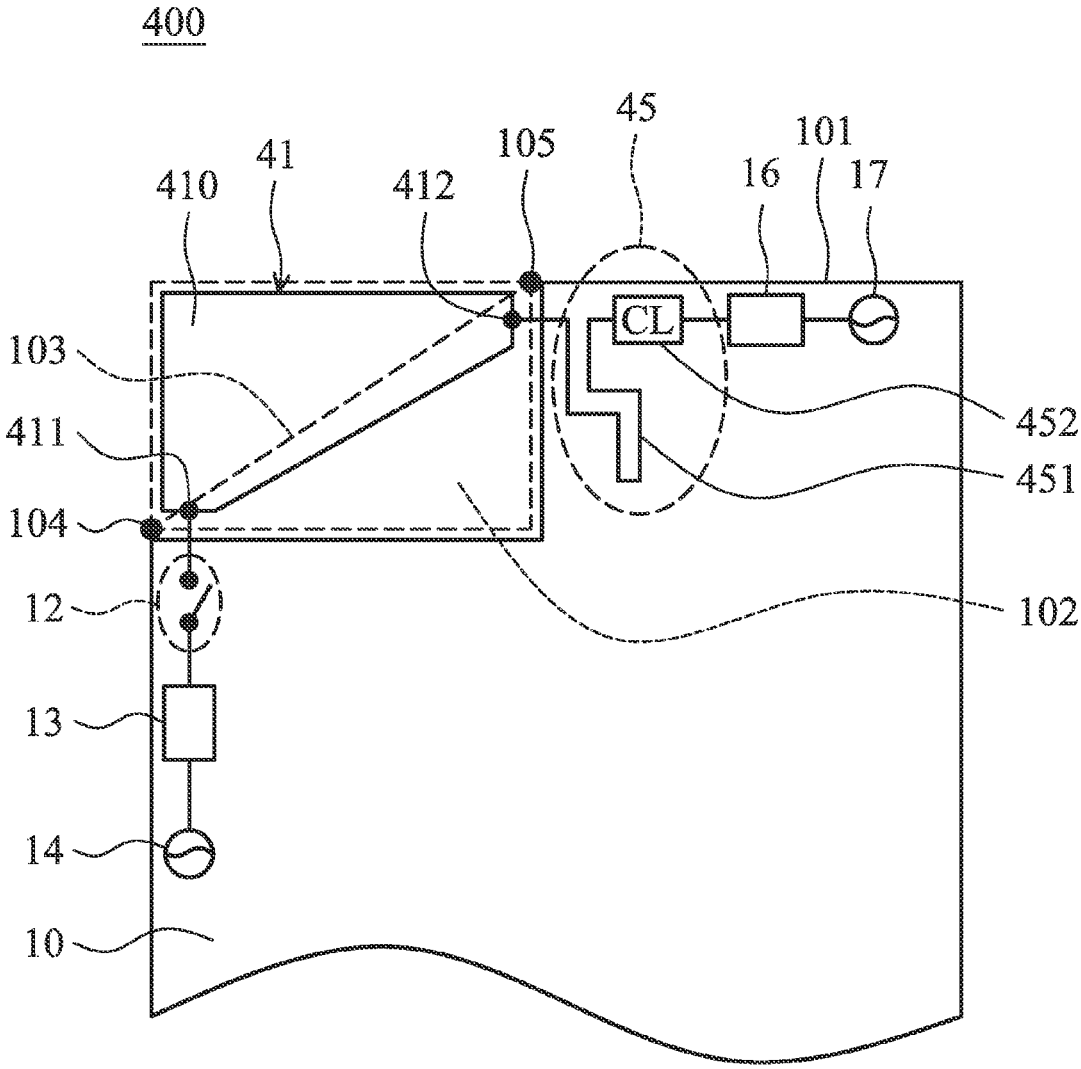
FIG. 4 is a diagram for illustrating a communication device according to a second embodiment of the invention.

FIG. 4 is a diagram for illustrating a communication device 400 according to a second embodiment of the invention. The second embodiment is basically similar to the first embodiment. The difference between the two embodiments is that a metal element 410 of an antenna element 41 of the communication device 400 substantially has a triangular shape and that an inductive element 45 of the communication device 400 comprises a combination of a distributed inductor 451 and a chip inductor 452. In the communication device 400, a first end 411 and a second end 412 of the metal element 410 (i.e., a first feeding point and a second feeding point of the antenna element 41) are still respectively positioned adjacent to the two ends 104 and 105 of the diagonal line 103 of the notch 102. Other features of the second embodiment are similar to those of the first embodiment. Accordingly, the two embodiments can achieve similar performances.

Figure 5:
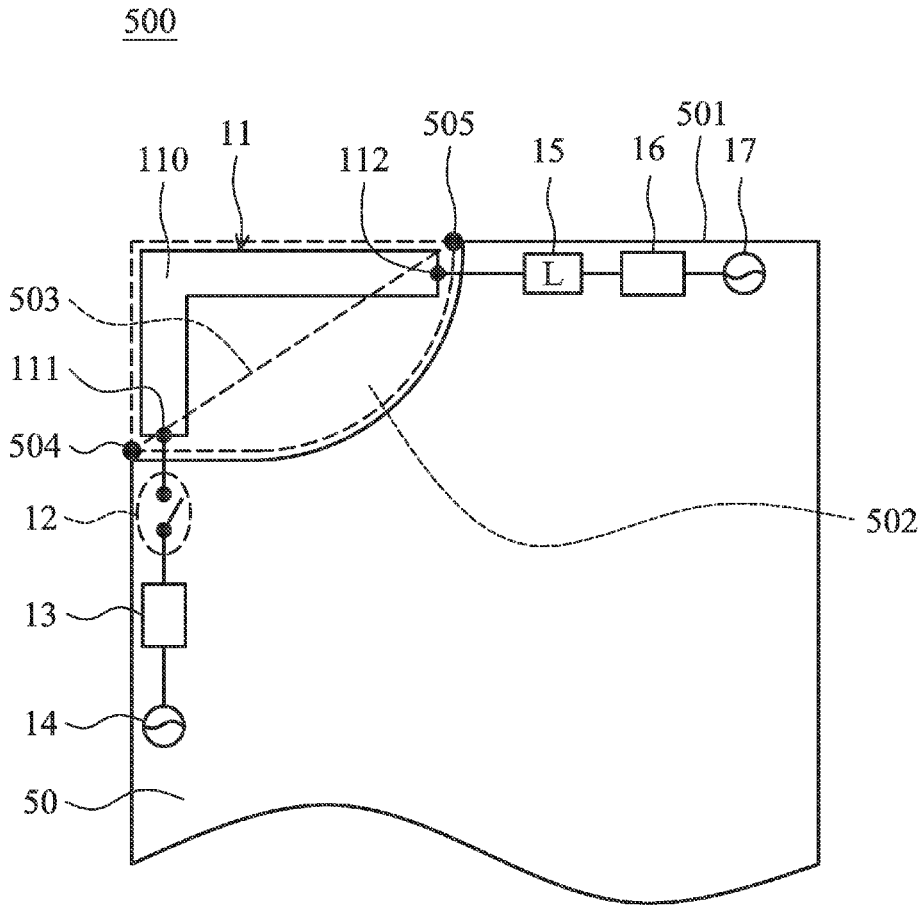
FIG. 5 is a diagram for illustrating a communication device according to a third embodiment of the invention.

FIG. 5 is a diagram for illustrating a communication device 500 according to a third embodiment of the invention. The third embodiment is basically similar to the first embodiment. The difference between the two embodiments is that a notch 502 of a ground element 50 of the communication device 500 substantially has a smoothly curved edge. In the communication device 500, the first end 111 and the second end 112 of the metal element 110 (i.e., the first feeding point and the second feeding point of the antenna element 11) are still respectively positioned adjacent to two ends 504 and 505 of a diagonal line 503 of the notch 502. Other features of the third embodiment are similar to those of the first embodiment. Accordingly, the two embodiments can achieve similar performances.

The invention proposes a communication device and an antenna element therein. The antenna element comprises a ground plane antenna which is excited to generate a ground plane mode to improve the radiation performance thereof. Accordingly, the invention can effectively reduce the total size of the antenna element and the communication device, and can be suitably applied to a variety of small mobile devices.

Note that the above element sizes, element shapes, element parameters, and frequency ranges are not limitations of the invention. An antenna designer can adjust these setting values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element, wherein an edge of the ground element has a notch; and an antenna element, comprising a metal element, wherein the metal element is disposed inside the notch, the metal element has a first end and a second end, the first end and the second end are spaced away from each other and are respectively positioned adjacent to two ends of a diagonal line of the notch, the first end of the metal element is used as a first feeding point of the antenna element, and the second end of the metal element is used as a second feeding point of the antenna element;

wherein the first feeding point is coupled through a switch and a first matching circuit to a first signal source, and the second feeding point is coupled through an inductive element and a second matching circuit to a second signal source.

2. The communication device as claimed in claim 1, wherein when the switch is closed, the antenna element is fed from the first feeding point and operates in a first band.

3. The communication device as claimed in claim 2, wherein the first matching circuit provides a first reactance, and a total length of the metal element is smaller than 0.15 wavelength of the lowest frequency in the first band.

4. The communication device as claimed in claim 2, wherein when the switch is open, the antenna element is fed from the second feeding point and operates in a second band, wherein frequencies of the second band are lower than frequencies of the first band.

5. The communication device as claimed in claim 4, wherein the second matching circuit provides a second reactance, and a total length of the metal element is smaller than 0.15 wavelength of the lowest frequency in the second band.

6. The communication device as claimed in claim 4, wherein the first band at least covers bands which are approximately from 1710 MHz to 2690 MHz, and the second band at least covers bands which are approximately from 824 MHz to 960 MHz.

7. The communication device as claimed in claim 1, wherein the inductive element is a chip inductor, a distributed inductor, or a combination of the chip inductor and the distributed inductor.

8. The communication device as claimed in claim 1, wherein the metal element substantially has an inverted L-shape or a triangular shape.

9. The communication device as claimed in claim 1, wherein the notch of the ground element substantially has a rectangular shape or substantially has a smoothly curved edge.

10. The communication device as claimed in claim 1, wherein the notch of the ground element is substantially formed at a corner of the ground element.

* * * * *